US005364180A

United States Patent [19]

Berger

[11] Patent Number: 5,364,180

[45] Date of Patent: Nov. 15, 1994

[54] DRAWER SIDE WALL FORMED OF AN UPPER DOUBLE-WALLED PROFILE SECTION AND A BOTTOM PROFILE SECTION INSERTED INTO THE OPEN BOTTOM OF THE UPPER PROFILE SECTION

[75] Inventor: Horst Berger, Bielefeld, Germany

[73] Assignee: Mepla-Werke Lautenschläger GmbH & Co. KG, Reinheim, Germany

[21] Appl. No.: 1,790

[22] Filed: Jan. 8, 1993

[30] Foreign Application Priority Data

Jan. 11, 1992 [DE] Germany ..... 4200581

[51] Int. Cl.[5] ..... A47B 88/00

[52] U.S. Cl. ..... 312/334.14; 312/334.2

[58] Field of Search ..... 312/330.1, 334.1, 334.7, 312/334.14, 334.27, 348.1; 403/231, 316

[56] References Cited

U.S. PATENT DOCUMENTS

| | | | |
|---|---|---|---|
| 3,733,113 | 5/1973 | Glassford et al. | 312/330.1 |
| 4,011,706 | 3/1977 | Dupree | 403/231 |
| 4,173,380 | 11/1979 | Dupree | 403/231 X |
| 4,458,965 | 7/1984 | Ohlendorf | 312/330.1 |
| 4,632,473 | 12/1986 | Smith | 403/231 X |
| 4,802,716 | 2/1989 | Rock et al. | 312/330.1 |
| 5,172,971 | 12/1992 | Albiez | 312/330.1 X |
| 5,253,706 | 10/1993 | Reid | 403/316 X |

FOREIGN PATENT DOCUMENTS

| | | |
|---|---|---|
| 2813778 | 10/1979 | Germany . |
| 9102828 | 7/1991 | Germany . |

*Primary Examiner*—Kenneth J. Dorner
*Assistant Examiner*—Nancy Mulcare

[57] ABSTRACT

The present invention relates to a drawer side made of metal. The drawer side includes a double-walled upper profile section bent from sheet metal and open at the bottom, into whose open bottom a bottom profile section (14) which is separately made and joined to the upper profile section is inserted, so that the drawer side is formed by a closed hollow profile. The bottom profile section (14) is inserted into the open bottom of the double-walled upper profile section (12) bent from sheet metal. The bottom profile section is made of plastic, preferably by an injection molding process from a thermoplastic.

12 Claims, 3 Drawing Sheets

DRAWER SIDE WALL FORMED OF AN UPPER DOUBLE-WALLED PROFILE SECTION AND A BOTTOM PROFILE SECTION INSERTED INTO THE OPEN BOTTOM OF THE UPPER PROFILE SECTION

The invention relates to a drawer side, consisting of a double-walled sheet metal piece open at the bottom, into the open bottom of which a separately made bottom piece is inserted and affixed to the upper piece, so that the drawer side is a closed hollow part.

In built-in and free-standing furniture, drawers have recently been used in certain applications, in which the drawer sides are made of plastic or metal shapes, drawers with sides made of hollow metal shapes being used especially for large drawers of large capacity intended for holding heavy parts or objects, i.e., which are exposed to heavy-weight loads. The most frequently used hollow-chamber shapes are made of light metal alloys which offer the advantage not only of the required strength but also of light weight and, being made by extrusion, they can also be made in cross-sectional shapes which offer the possibility of the concealment of hardware used in joining the sides to the back and/or front of the drawer, holding the drawer bottom, and even the concealment of the rail of the drawer guide. Metal hollow shapes extruded from aluminum alloy, however, are comparatively expensive due to the required heavy investment in the extruders and extrusion dies.

For the manufacture of metal drawer sides in small numbers and in special dimensions, for which the investment in extrusion machinery is not justified, the production of hollow metal drawer sides of the kind mentioned above (DE-OS 39 34 419, FIG. 3) has been proposed in which a bottom piece bent from sheet metal is inserted into the upper piece also bent from sheet metal, and the two pieces are fastened together by electrical resistance welding. These hollow-chamber drawer-side pieces made in this manner from sheet metal have proven basically good for the abovementioned special applications, but on account of the need to weld the sections together their manufacture is still relatively complex and consequently expensive.

The invention is addressed to the problem of creating a hollow piece that can be used for drawer sides, which will be even simpler and less expensive to manufacture, without impairing its appearance or its load-carrying capacity.

This problem is solved in accordance with the invention by making the bottom piece of plastic to be inserted into the open bottom edge of the double-walled sheet-metal upper section, this bottom piece being best made by injection molding from plastic.

In one preferred embodiment of the invention, the configuration is made such that the upper profile section bent from sheet metal has a pair of connecting flanges running over substantially the entire length of the section at a distance from its edges defining the open bottom, each connecting flange being formed by a strip-like web section projecting from each of the inner sides of the walls facing one another and forming the drawer sides, and by a dependent section bent downwardly substantially at right angles from the boundary edge of the web section extending .away from the wall, and that in the plastic bottom profile section two grooves are provided which run essentially over the entire length of the insert, are associated with the connecting flange, and open at least at one end in an end face of the bottom profile section, one for each of the connecting flanges, into which the connecting flanges are fitted. The bottom profile section made of plastic is installed in the upper section bent from sheet metal so as to form a strong hollow drawer side simply by inserting the bottom insert into the upper section, letting the connecting flanges become engaged in the corresponding grooves.

The connecting flanges are preferably configured as an integral unit with the vertical walls of the upper profile section of the drawer side; they can be bent downward from the upper margin of metal strips whose bottom margin is integral with each of the margins of the vertical walls defining the open bottom and they are bent 180° against the inside of the wall of the upper part of the drawer side.

The groove formed in the bottom plastic profile section and engaging the connecting flange is, in an advantageous further development of the invention, formed of a plurality of groove sections succeeding one another along the length of the bottom profile section, which are open alternately toward the associated vertical wall of the upper section and at right angles thereto toward the web section of the connecting flange. The groove is thus divided into a succession of groove sections running longitudinally, which reach alternately beneath and behind the web section and the dependent section of the connecting flange. Since these groove sections are each open on one side, the manufacture of the bottom profile section by the injection molding process from thermoplastic is made possible, and in spite of the angular shape of the grooves over their entire length, the injection molding die can be made relatively simply, because simple, flat die cores can be provided for forming the individual groove sections.

The plastic bottom profile section, in a desirable further development of the invention, can have in cross section essentially the profile of an angle iron with two flanges substantially at right angles to one another, the horizontal flange being disposed inside of the open section of the profile and being there joined to this upper section of the profile, while the vertical limb of the angle projects from the bottom limit of the upper section of the profile.

Fastening means for the mounting of a drawer bottom can be provided on the dependent limb of the bottom profile section. If this drawer bottom is formed of a relatively thick board of wood material, the fastening means can be made of harpoon tabs projecting from the vertical limb toward the drawer bottom, which can be driven into corresponding slots in the lateral edges of the drawer bottom. For thinner drawer bottoms, the fastening means can alternatively be constituted by a flange bent at right angles toward the drawer from the bottom free margin of the dependent limb of the bottom profile section, and reaching underneath the drawer bottom.

At the back end of the plastic bottom profile section of the drawer side, means can best be provided for the releasable fastening of a corner piece joining the drawer side to the drawer back; it can also be made of plastic, for example, and screwed to the bottom profile section.

In the end portion adjacent the drawer front of the bottom profile section, it is desirable then to provide means for holding a drawer front mounting device, so that this mounting device will be situated invisibly in the interior of the drawer side.

At least a portion of the means for releasably fastening the runner rail of a drawer guide can be provided on the plastic bottom profile section of the drawer side.

If the fastening of the runner rail in a manner known in itself near the carcase-interior, rearward end is accomplished by means of a tongue or pin which can be inserted into a bore in the carcase-interior end face provided at a distance above and parallel to the runner rail, on the one hand, and on the other hand by means of a spring tongue offset from the drawer front and engaging the latter when the runner rail is inserted and securing it against withdrawal, then the spring tongue can be constituted by a section integral with the dependent limb of the bottom profile section and cut free from the latter.

The invention is further explained in the following description of an embodiment in conjunction with the drawing, wherein:

FIG. 1 is an exploded perspective representation, simplified as regards the representation of details, of a drawer provided with sides made in the manner of the invention, FIG. 2 is a perspective view of the back end portion of the bottom profile made of plastic, of the drawer side in accordance with the invention, wherein the upper profile section bent from sheet metal is also indicated in broken lines to show how it is attached to the bottom profile section.

Figure 1:
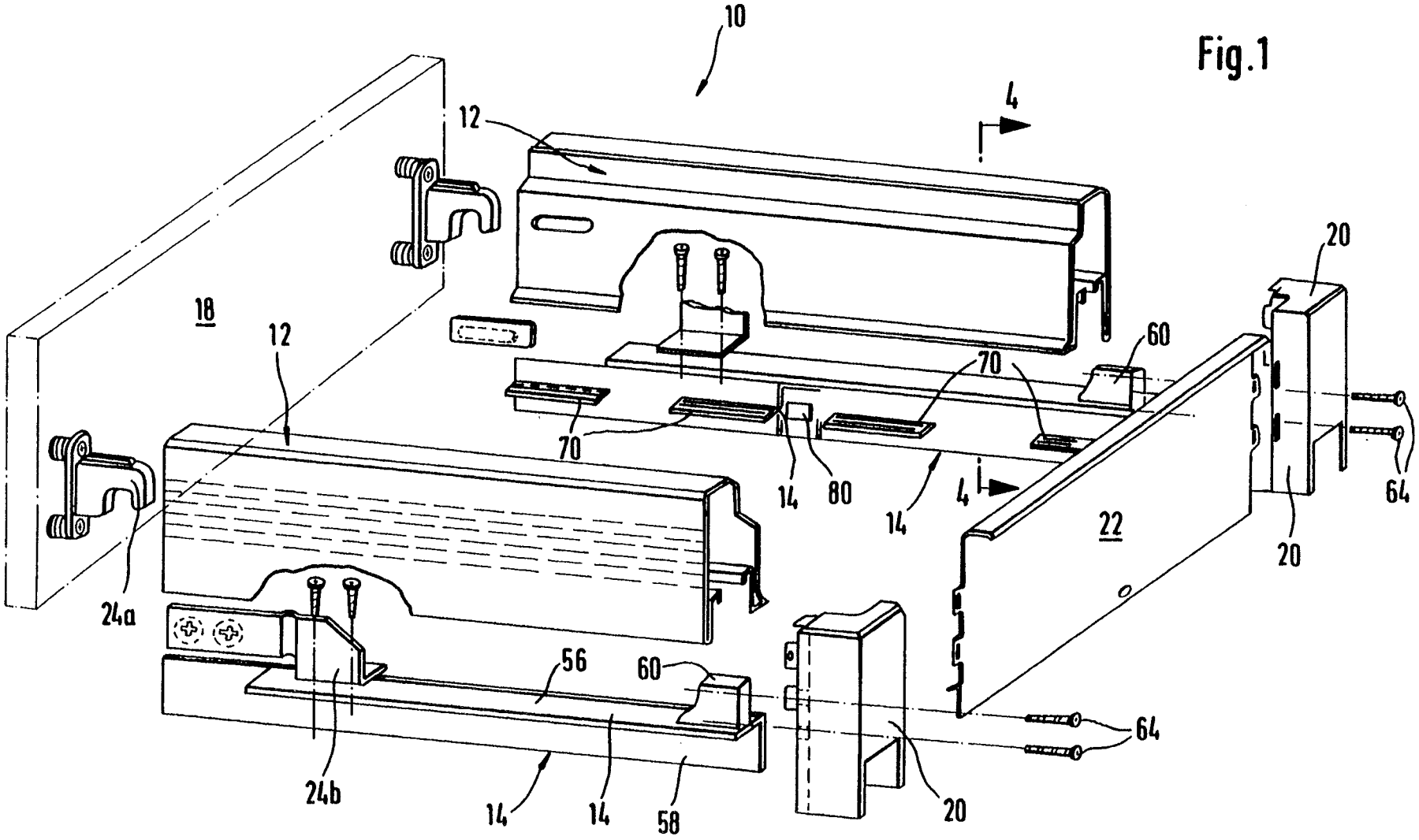

In the figures of the drawing, FIG. 1, an exploded view, shows a drawer identified generally by 10, from which the board forming the drawer bottom has been omitted for the sake of simplicity. The drawer 10 is composed otherwise of the two drawer sides each consisting of an upper double-walled profile section 12 bent from sheet metal and enclosing a cavity, which is open at the bottom and at both ends, and a bottom profile section 14 made of plastic and inserted into the open bottom of profile section 12, a drawer front 18, and a back wall 22 which in the present case is a single wall of sheet metal held by corner pieces 20 of plastic to the back ends of the drawer sides. To fasten the drawer front 18 to the sides 16, releasable fittings 24 are provided, each consisting of a piece 24a on the inside face of the drawer front 18, and another piece 24b associated therewith and mounted on the bottom profile section 14 inside of the upper section 12. The manner in which the drawer front 18 is fastened to the drawer sides 16 as well as the joining of the drawer back 22 to the drawer sides by corner fasteners is basically known and not part of the invention, which is concerned with the special configuration of the drawer sides 16 which will be explained in connection with FIGS. 2 to 5.

Figure 3:
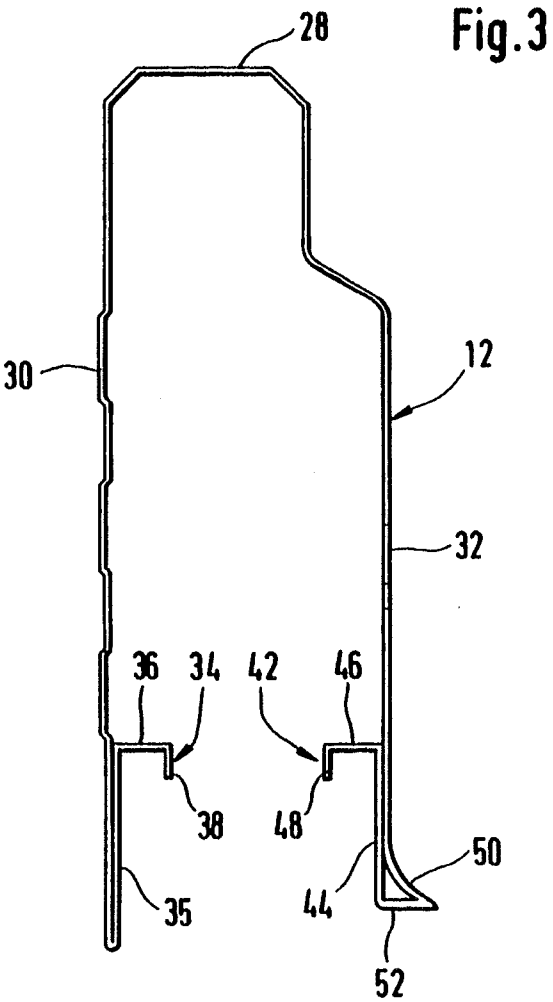
FIG. 3 is a view of the open end of the upper profile section, bent from sheet metal, of the drawer side in accordance with the invention which is represented in FIG.

The upper profile section 12 is bent from sheet metal, as previously stated, and has the cross-sectional shape shown in FIG. 3. That is, it has two substantially vertical walls 30 and 32 held apart by a web 28, which can also be shaped for appearance and reinforcement. A metal strip 35 is made integral with the bottom edge of the outer wall 30, being bent 180° against the inside of the wall 30. From the original bottom margin which then is situated inside the walls 30, 32, an inwardly reaching flange 34 is bent, which is made up of a web section 36 projecting at right angles from the inside face of wall 30, and a section 38 bent downward at right angles from the free margin of the web section. A flange 42 corresponding to flange 34 projects from the inside face of the wall 32. Flange 42 is also composed is composed of a horizontal web 46 and a vertical section 48. The horizontal web section 46 projects at right angles from a metal strip 44 being bent against the inside of the wall 32.

To form a cove to constitute a rounded transition from the inner wall 32 to the drawer bottom, the wall 32 is curved arcuately outward at its bottom marginal portion 50, so that another short, horizontal flat 52 has to be provided to join the sheet metal strip 44 to the bottom margin of the wall 32.

Figure 2:
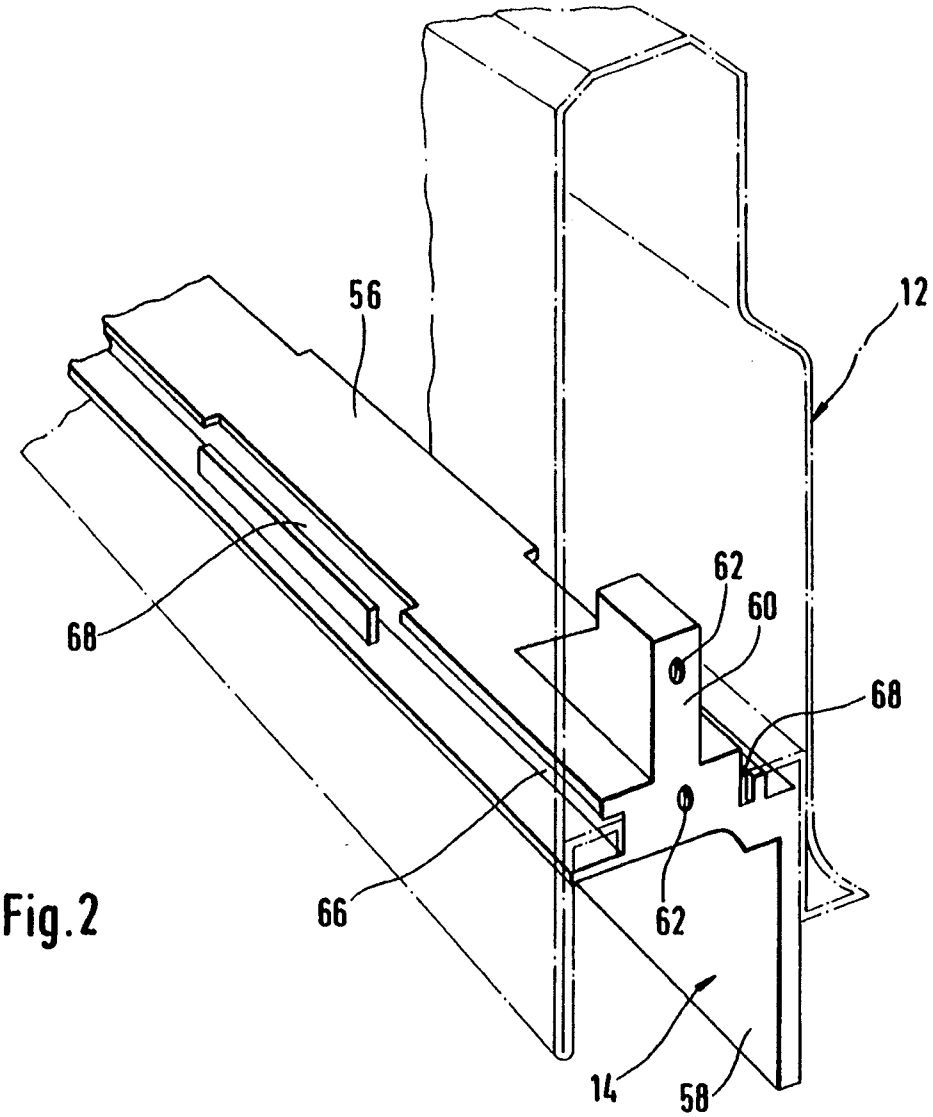
Figure 5:
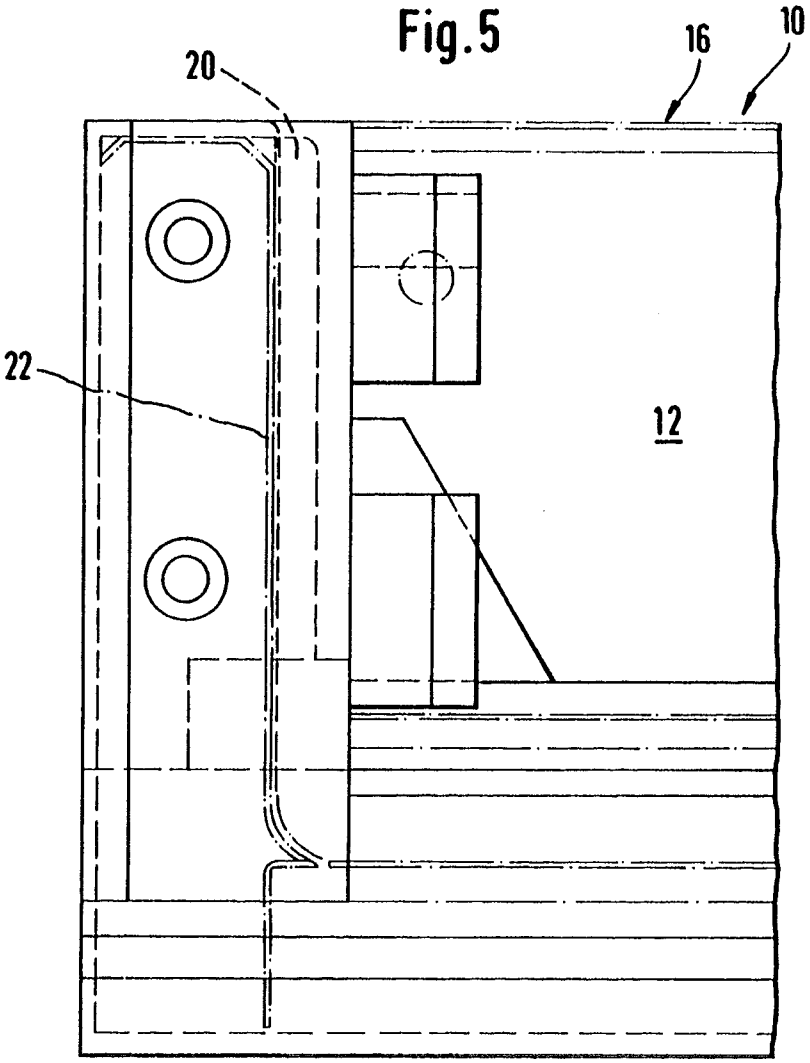
FIG. 5 is a view of the drawer corner seen in the direction of 1 arrow 5 in FIG. 4.
Figure 4:
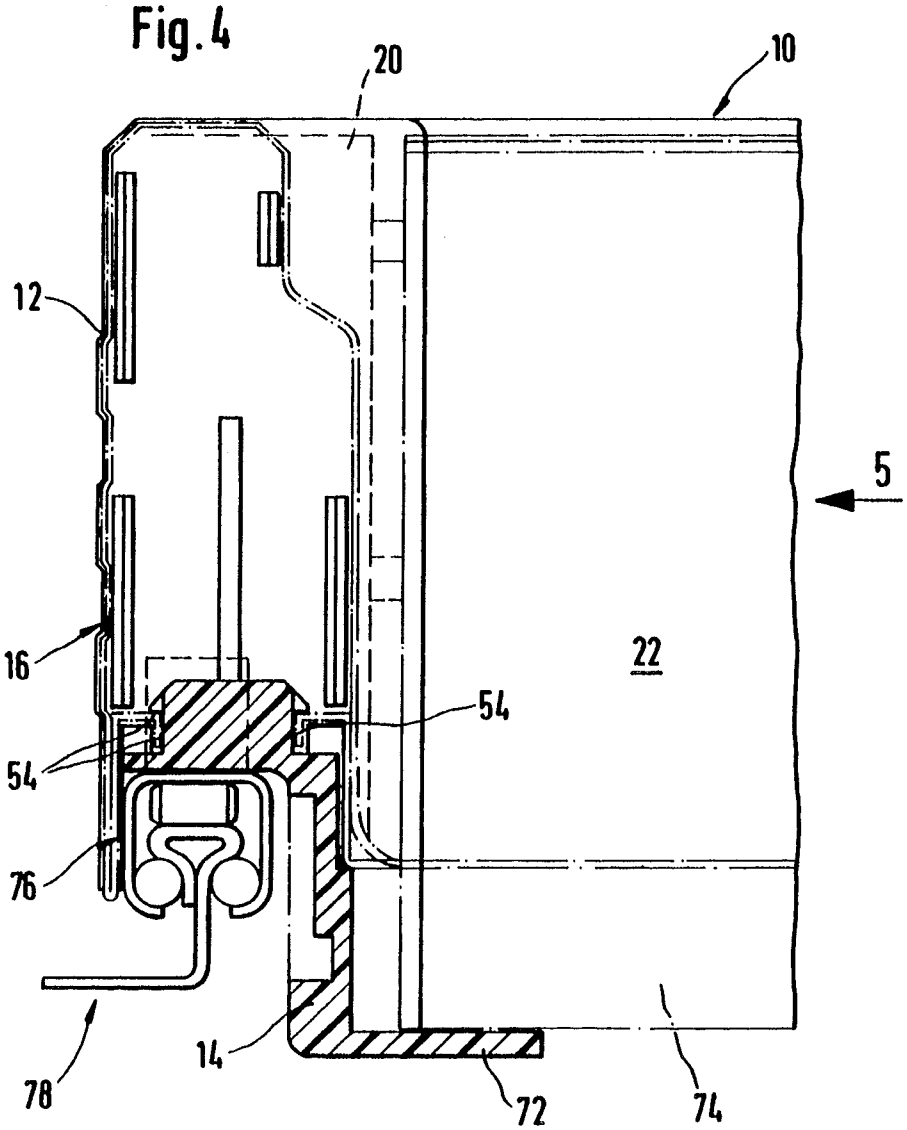
FIG. 4 is a sectional view of a bottom back corner of the drawer shown in FIG. 1, in the assembled state, as seen in the direction of the arrows 4–4 in FIG. 1.

The bottom profile section 14 made by injection molding from plastic, and particularly its carcase-interior end portion, is represented on an enlarged scale in FIG. 2, wherein it can be seen that the connecting flanges 34 and 42 of the upper profile section 12, represented in this figure in broken lines, are engaged in grooves 54 [see FIG. 4], which are provided in the upper side of a substantially horizontal portion 56 [see FIG. 2] of the bottom profile section 14 from which a vertical angle limb 58 depends, which also extends beyond the bottom of profile section 12.

In FIG. 2 it can also be seen that, on the rearward, i.e., carcase-interior end of bottom profile section 14 a projection 60 reaching upward into the cavity formed between the walls 30 and 32 is provided, which has a threaded bore 62 in its end face pointing into the carcase interior and flush with the inner end of the upper profile section 12. Another threaded bore 62 is provided in the rear-end face adjoining the horizontal portion 56. This threaded bore serves to accommodate mounting screws 64 with which the corner fasteners 20 are screwed to the drawer side 16.

The flanges 34 and 42 become engaged in the groove 54 associated with each, i.e., these grooves 54 have a cross-sectional shape corresponding to that of the flanges 34 and 42, as seen from the back end face of the bottom profile section 14. Since a throughgoing groove 54 of this cross sectional shape is difficult or impossible to realize, the groove is divided into a number of sections 66 and 68 succeeding one another in the lengthwise direction, the last one 66 of which, for example, provided at the back end and associated with the outer wall 30, has the width of the flange 38 and is open toward the wall 30, while the next succeeding section 68 is open upward, i.e., toward the web 28 [at the top] of the upper profile section 12, so that the flange 38 engages the groove section 68 from above. In this manner the flange 34 is held alternately in groove sections 66 and 68, so that the bottom profile section 14 is locked into the upper profile section 12. Corresponding groove sections 66 and 68 are associated with the connecting flange 42 and are disposed offset preferably by the length of one groove section from the groove sections 66 and 68 associated with the wall, so that therefore a groove section 68 associated with the wall 32 is always opposite a groove section 66 associated with the connecting flange 34 on the wall 30, and a groove section 66 is always opposite the groove section 68 associated with the wall 30.

The division of the groove 54 into the groove sections 66 and 68 makes it possible to injection-mold the bottom profile section 14 from plastic without making the die too complicated. The installation of the bottom profile section 14 in the upper profile section 12 is performed by inserting the profile section 14 into the upper profile section from the back or front open end 12, the connecting flanges 34 and 42 being anchored in the receiving groove 54. No additional fixation of the bottom profile section 14 in the upper profile section 12 is necessary, because the bottom profile section 14 is held in the upper profile section 12 at the back end by the corner connectors 20 and at the front, carcase-exterior end it is held against shifting relative to the upper profile section 12 by the drawer front 18.

In FIG. 1, harpoon tabs 70 spaced apart from one another are represented on the vertical limb 56 [58] of the angle of the bottom profile section 14, and they can be driven into a slot in the drawer bottom which is made appropriately thick, and they can thus fix the drawer bottom in place.

As an alternative, a flange 72 (FIG. 4) can also be provided on the bottom edge of the vertical limb 38, and it will then reach underneath the drawer bottom 74. The drawer bottom 74 is secured against lifting away from the flange 72 by the curved bottom margin section 50 which forms the edge of the inner wall 32.

In FIG. 4 is shown the arrangement of the runner rail 76 of a drawer guide 78 which guides the drawer in the carcase as it is pulled out. This runner rail 76 can have at its back end the conventional prong which is stamped from the material of the runner rail itself and shaped by bending it twice. These prongs are inserted into an associated bore or hole in the corner connector 20 to hold the carcase-interior end of the runner rail 76 in place. For the additional fixation of the runner rail, a resilient tongue 80 (FIG. 1) is provided in the vertical limb 58 of the bottom profile section 14, which cooperates with a projection or recess (not shown) in the runner rail 76 and catches the runner rail 76 inserted into the bottom of the drawer side 16 from the rearward, carcase-interior end, so as to keep it from being pulled out. If the elasticity of the plastic used in making the bottom profile section 14 is sufficient this resilient tongue can be an integral part of the bottom profile section 14, so that it is not necessary to fasten an additional metal tongue to the limb 58.

I claim:

1. A drawer side, comprising:

a double-walled upper profile section bent from sheet metal and having an open bottom;

a bottom profile section joined to the upper profile section by insertion into the open bottom of said upper profile section, so that the drawer side is formed by a closed hollow profile;

said upper profile section comprising vertical walls, said walls having inner confronting sides, said upper profile section having margins defining said open bottom, and having, at a distance from said margins, a pair of connection flanges, each flange extending substantially over an entire length of said upper profile section from the inner confronting sides of said vertical walls forming said drawer side, each said connection flange being formed in each case by a strip-like web section and a dependent section bent substantially at right angles from a defining edge of the web section turned away from one of said vertical walls, and said bottom profile section having receiving grooves therein which are each associated with one of said connecting flanges, extending substantially over the entire length of said bottom profile section; and said bottom profile section having an opening in at least one end in an end face for each of the connecting flanges so that said connecting flanges are closely fitted therein, wherein each of said receiving grooves is formed by a plurality of successive groove sections which are open alternately toward an associated vertical wall of said upper profile section and at right angles thereto toward a respective one of said web sections of said connecting flanges.

2. The drawer side according to claim 1, wherein the bottom profile section is made of a thermo-plastic material.

3. The drawer side according to claim 1, wherein the connecting flanges are configured as an integral unit of the vertical walls of the upper profile section.

4. The drawer side according to claim 4 wherein the connecting flanges are formed from a strip of sheet metal having an upper margin and a lower margin and wherein the upper margin of the strip of sheet metal is bent to form the connecting flanges and the lower margin of the strip of sheet metal is integrally attached to one of the margins of the upper profile section vertical side walls and is bent at 180 degrees against the vertical side wall of the upper profile section.

5. The drawer side according to claim 1, as wherein the bottom profile section an angular profile shape formed of two limbs substantially at right angles to one another, one of said limbs is a horizontal limb disposed in an interior surface of the upper profile section and joined to said upper profile section, and another limb is a vertical limb projecting from a bottom boundary of the upper profile section.

6. The drawer side according to claim 5, wherein connecting means are provided on the vertical limb said connecting means protecting downward from the upper profile section for holding a drawer bottom.

7. The drawer side according to claim 6, wherein the correcting means for holding the drawer bottom are formed by harpoon tabs projecting from the vertical limb toward the drawer bottom.

8. The drawer side according to claim 6, wherein connecting means for holding the drawer bottom are formed by a strip-like supporting flange bent at right angles from the bottom free margin of the downwardly projecting vertical limb of the bottom profile section.

9. The drawer side according to claim 1, wherein the bottom profile section has a back end and fastening means are provided for the releasable fastening of a corner connector connecting the drawer side to the drawer back on the back end of the bottom profile section of plastic.

10. The drawer side according to claim 1, wherein holding means are provided for holding a drawer front holding device in the front end of the bottom profile section of plastic adjacent the drawer front.

11. A drawer side according to claim 1 further comprising a releasable attaching means which is at least partially provided on the bottom profile section for releasably attaching a runner rail of a drawer guide.

12. The drawer side according to claim 17, further comprising a holding tongue receivable in the vertical limb of the bottom profile section for holding a running rail in a desired position for fastening the running rail for a corresponding drawer guide provided in an area of a carcase-interior end at a distance above and parallel to the runner rail, which can be inserted into a bore or recess in a carcase-interior end face, or a holding pin on the one hand and, a spring tongue offset toward a front of the drawer and, when the runner rail is inserted, engages and secures the tongue against withdrawal from said runner rail, when said tongue is an, integral section of the material of said vertical limb cut free along three sides from said vertical limb of the bottom profile section.

* * * * *